US010212992B2

(12) United States Patent
Honda

(10) Patent No.: US 10,212,992 B2
(45) Date of Patent: Feb. 26, 2019

(54) SLIDER FOR SLIDE FASTENER

(71) Applicant: YKK Corporation, Tokyo (JP)

(72) Inventor: Shinya Honda, Toyama (JP)

(73) Assignee: YKK Corporation (JP)

( * ) Notice: Subject to any disclaimer, the term of this patent is extended or adjusted under 35 U.S.C. 154(b) by 121 days.

(21) Appl. No.: 15/511,412

(22) PCT Filed: Sep. 19, 2014

(86) PCT No.: PCT/JP2014/074949

§ 371 (c)(1),
(2) Date: Mar. 15, 2017

(87) PCT Pub. No.: WO2016/042676

PCT Pub. Date: Mar. 24, 2016

(65) Prior Publication Data

US 2017/0295891 A1 Oct. 19, 2017

(51) Int. Cl.
*A44B 19/26* (2006.01)

(52) U.S. Cl.
CPC ..... *A44B 19/262* (2013.01); *A44B 19/26* (2013.01)

(58) Field of Classification Search
CPC ..... A44B 19/26; A44B 19/262
See application file for complete search history.

(56) References Cited

U.S. PATENT DOCUMENTS 1,899,529 A 2/1933 Rutherford
1,953,726 A 4/1934 Rutherford
2,838,969 A * 6/1958 Simmons, Sr. ..... B21D 53/54 227/39
2,855,652 A * 10/1958 Jones ..... A44B 19/265 24/426
4,048,699 A * 9/1977 Kanzaka ..... A44B 19/26 24/421
5,007,144 A * 4/1991 Terada ..... A44B 19/26 24/415

(Continued)

FOREIGN PATENT DOCUMENTS

CN 102860637 A 1/2013
JP 128007/1978 10/1978
WO 2014/073111 A1 5/2014

OTHER PUBLICATIONS

International Preliminary Report on Patentability, PCT International Patent Application No. PCT/JP2014/074949, dated Mar. 30, 2017.

(Continued)

*Primary Examiner* — Jason W San
(74) *Attorney, Agent, or Firm* — Kilpatrick Townsend & Stockton LLP

(57) ABSTRACT

A slider for slide fasteners may include a slider body and a closure part. The closure part may include a closure portion for closing the gap between a free end portion of a pull tab attachment post and an upper blade; an upper engaging portion provided above the closure portion and engageable with the free end portion of the pull tab attachment post and a leg portion provided below the closure portion. The leg portion may include a rod portion extending from the closure portion along the coupling post and a lower engaging portion coupled to the rod portion and engageable with a lower blade.

10 Claims, 10 Drawing Sheets

(56) References Cited

U.S. PATENT DOCUMENTS 5,086,546 A * 2/1992 Aoki ..... A44B 19/26 24/429
5,400,481 A * 3/1995 Oda ..... A44B 19/26 24/424
5,551,129 A * 9/1996 Chu ..... A44B 19/26 24/419
5,625,928 A * 5/1997 Terada ..... A44B 19/308 24/421
6,094,786 A * 8/2000 Wakabayashi ..... A44B 19/26 24/419
6,701,584 B2 * 3/2004 Metzger ..... A44B 19/265 24/415
8,122,573 B2 * 2/2012 Takazawa ..... A44B 19/308 24/418
9,456,663 B1 * 10/2016 Wheeler ..... A44B 19/301
9,763,498 B2 * 9/2017 Kojima ..... A44B 19/262
9,968,166 B2 * 5/2018 Inukai ..... A44B 19/26
2013/0025092 A1 * 1/2013 Ozawa ..... A44B 19/26 24/429
2014/0082895 A1 * 3/2014 Gold ..... A44B 19/26 24/415
2015/0335107 A1 * 11/2015 Hamada ..... A44B 19/26 24/429
2015/0351501 A1 * 12/2015 Zana ..... A44B 19/26 24/429
2016/0135552 A1 * 5/2016 Li ..... A44B 19/308 24/424
2017/0224061 A1 * 8/2017 Yamagishi ..... A44B 19/30
2017/0290394 A1 * 10/2017 Hamada ..... A44B 19/262

OTHER PUBLICATIONS

International Search Report, PCT International Patent Application No. PCT/JP2014/074949, dated Dec. 16, 2014.

* cited by examiner

SLIDER FOR SLIDE FASTENER

This application is a national stage application of PCT/JP2014/074949, which is incorporated herein by reference.

TECHNICAL FIELD

The present disclosure relates to a slider for slide fasteners. In particular, the present disclosure relates to a slider, a slider body, and a closure part.

BACKGROUND ART

There is known a technique of subsequent-attaching (retro-attaching) of a pull tab to a slider body provided with a cantilevered pull tab attachment post. To allow the subsequent attachment of the pull tab, a gap may be present between a free end of the pull tab attachment post and an upper blade of the slider body. This gap may be required at a time of subsequent-attaching of the pull tab, but it may be redundant after the attachment of the pull tab. Therefore, in one method, the attachment of the pull tab may be followed by the pull tab attachment post being deformed so that the gap may be minimized. However, in this case, suppressing an undesired deformation of the slider body due to the application of force to the pull tab attachment post may be preferred, for example, in order to suppress variation of the interspace between the upper blade and the lower blade.

Even if the pull tab attachment post is deformed such as in the above example, the gap may somewhat remain, and foreign objects such as bags will be caught in this gap, so that ease of use for the slide fastener may be impaired.

On the other hand, in other methods, there is known a technique of closing the gap between the free end of the pull tab attachment post and the upper blade using a closure part, thereby closing the gap, from the illustrative viewpoint as stated above or other view point than that stated above. For example, Patent Document 1 discloses a technique for disposing the closure part between the upper blade in the slider body and the free end of the pull tab installing rod as disclosed in FIGS. 1, 4, 7 and the like of this document.

Patent Document 2 discloses a slider having a special structure allowing subsequent attachment of the pull tab.

CITATION LIST

Patent Document 1: WO 2014/073111
Patent Document 2: U.S. Pat. No. 5,551,129

SUMMARY OF INVENTION

Technical Problem

In the case of Patent Document 1, the closure part may be relatively small and may not be easily attached to the slider body, and if simpler attachment is to be maintained, it may be easily detached when local force is applied thereto.

Solution to Problem

A slider according to one aspect of the present invention may be a slider for slide fasteners, comprising:

a slider body (100) that includes an upper blade (10); a lower blade (20); a coupling post (30); and a pull tab attachment post (50), wherein the coupling post (30) couples the upper blade (10) and the lower blade (20) at a front end portion (104) of the slider body (100), and the pull tab attachment post (50) extends from a base end portion (52) thereof coupled to the upper blade (10) to a free end portion (54) thereof towards the front end portion (104) in a cantilevered manner; and a closure part (200) that comprises a closure portion (210) for closing a gap (60) between the free end portion (54) of the pull tab attachment post (50) and the upper blade (10), wherein the closure part (200) comprises an upper engaging portion (215) provided at an upper section of the closure part (200) and engaged with the free end portion (54) of the pull tab attachment post (50); and a leg portion (220) provided at a lower section of the closure portion (210), and wherein the leg portion (220) comprises a rod portion (224) extending from the closure portion (210) along the coupling post (30); and a lower engaging portion (225) coupled to the rod portion (224) and engaged with the lower blade (20).

In some embodiments, a top surface (51) of the free end portion (54) of the pull tab attachment post (50) may be provided with a recessed upper engaged portion (55) with which the upper engaging portion (215) is engaged.

In some embodiments, the upper engaging portion (215) may have an engaging protrusion (217) protruding downward, the upper engaged portion (55) has a peripheral wall (56) that is opened upward, and the engaging protrusion (217) is housed in the peripheral wall (56). In addition, it is not necessary that the engaging protrusion is perfectly surrounded by the peripheral wall.

In some embodiments, the coupling post (30) has a vertical groove (33) that is front-open and vertically extends through the coupling post (30), and the rod portion (224) is at least partially housed in the vertical groove (33).

In some embodiments, the lower engaging portion (225) may be a flat plate portion bent relative to the rod portion (224), and is housed in the lower engaged portion (25) recessed on a bottom surface of the lower blade (20).

When a direction in which the coupling post (30) extends is defined as an up and down direction, a direction orthogonal to the up and down direction and consistent with a sliding direction of the slider is defined as a front and rear direction, and a direction orthogonal to the up and down direction and the front and rear direction is defined as a left and right direction, each of the upper engaging portion (215) and the lower engaging portion (225) has at least one protruding portion that protrudes in the left and right direction.

In some embodiments, a surface of the closure portion (210) facing the pull tab attachment post (50) may be provided with a slope (213) rising upward away from the base end portion (52) of the pull tab attachment post (50).

A closure part according to another aspect of the present invention may be a closure part (200) attachable to a slider body (100) that may include an upper blade (10); a lower blade (20); a coupling post (30); and a pull tab attachment post (50), the coupling post (30) coupling the upper blade (10) and the lower blade (20) at a front end portion (104) of the slider body (100), and the pull tab attachment post (50) extending from a base end portion (52) thereof coupled to the upper blade (10) to a free end portion (54) thereof towards the front end portion (104) in a cantilevered manner, the closure part comprising:

a closure portion (210) for closing a gap (60) between the free end portion (54) of the pull tab attachment post (50) and the upper blade (10);

an upper engaging portion (215) provided at an upper section of the closure part (200) and engageable with the free end portion (54) of the pull tab attachment post (50); and a leg portion (220) provided at a lower section of the closure portion (210), wherein the leg portion (220) comprises a rod portion (224) extending from the closure portion (210) along the coupling post (30); and a lower engaging portion (225) coupled to the rod portion (224) and engageable with the lower blade (20).

A slider body according to another aspect of the present invention may be a slider body (100) that comprises an upper blade (10); a lower blade (20); a coupling post (30); and a pull tab attachment post (50), the coupling post (30) coupling the upper blade (10) and the lower blade (20) at a front end portion (104) of the slider body (100), and the pull tab attachment post (50) extending from a base end portion (52) thereof coupled to the upper blade (10) to a free end portion (54) thereof towards the front end portion (104) in a cantilevered manner, and a closure part (200) being attachable to the slider body (100) to close a gap (60) between the free end portion (54) of the pull tab attachment post (50) and the upper blade (10), wherein the free end portion (54) of the pull tab attachment post (50) is provided with an upper engaged portion (55) with which an upper engaging portion (215) of the closure part (200) is engageable, and wherein the lower blade (20) is provided with a lower engaged portion (25) with which a lower engaging portion (225) of the closure part (200) is engageable.

In some embodiments, the coupling post (30) may have a vertical groove (33) that may be front-open and may vertically extend through the coupling post (30), the coupling post (30) being configured to house a rod portion (224) interposed between the upper engaging portion (215) and the lower engaging portion (225) of the closure part (200).

Advantageous Effects of Invention

According to the present invention, it may be possible to facilitate both of simplicity of attachment of the closure part to the slider body and difficulty of detachment of the closure part from the slider body.

DESCRIPTION OF EMBODIMENTS

Hereinafter, embodiments of the present invention will be described with reference to the drawings. Respective embodiments are not mutually exclusive, and the skilled person could properly combine them without requiring excess descriptions and could understand the synergic effects by such combinations. Overlapping descriptions among embodiments will be basically omitted. Referenced drawings are mainly for the purpose of illustrating the invention and may be simplified in an appropriate manner.

Terms indicating directions will be defined as follows. An up and down direction corresponds to a direction in which the coupling post extends. A left and right direction corresponds to a direction of horizontal alignment of openings on both sides of the coupling post. A front and back direction is orthogonal to the up and down and left and right directions. The front and back direction also corresponds to a moving direction of the slider for opening and closing slide fasteners, i.e., a sliding direction of the slider. The left and right direction also corresponds to a direction crossing the opposite side edges of the fastener tape. Based on the disclosure of the present application, terms indicating directions can be also defined in different expressions. For example, it is also possible to understand the left and right direction as a width direction, and understanding a size in the width direction of each element or a distance between the elements would be possible, as described below.

First Embodiment

Figure 1:
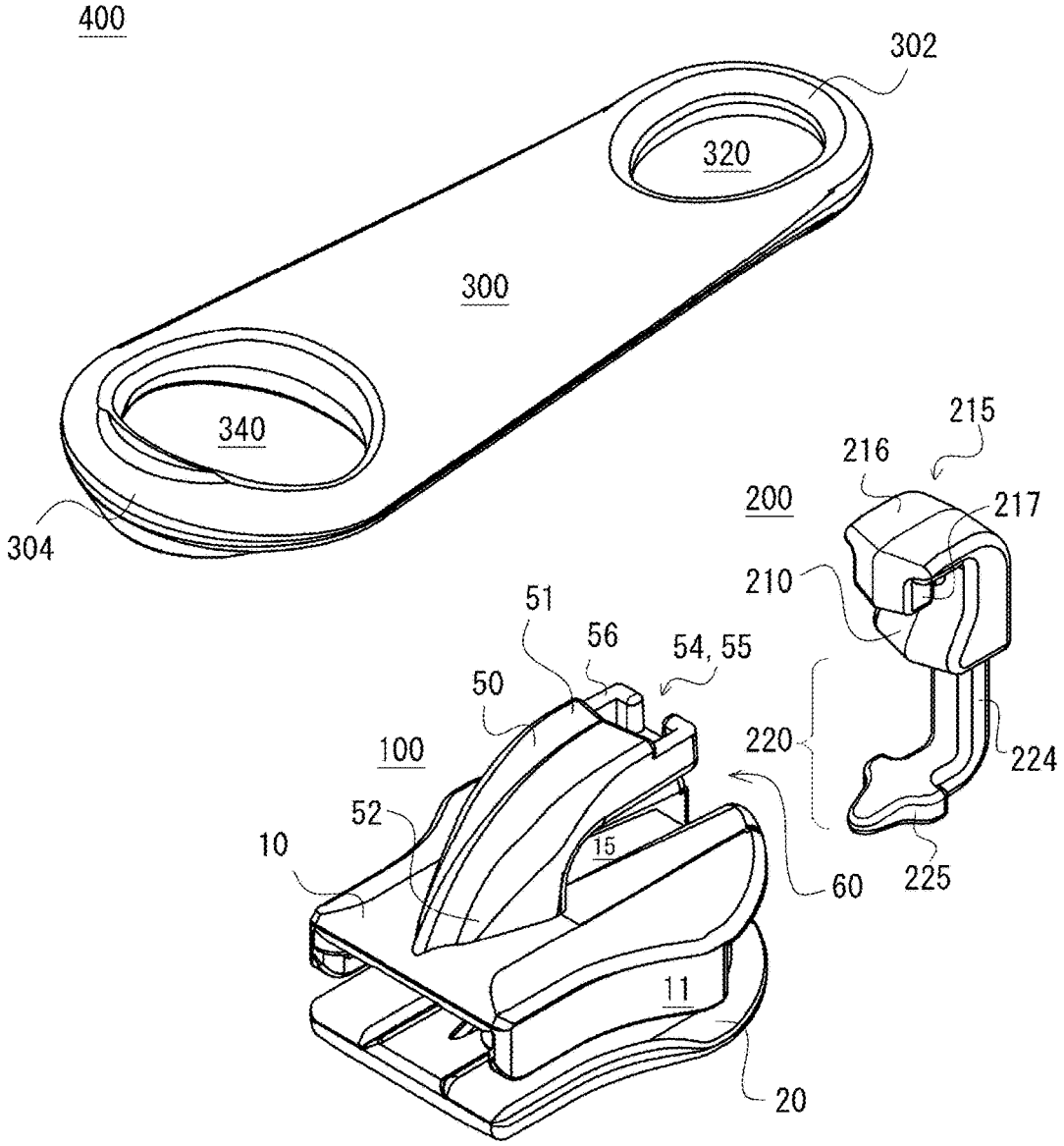
FIG. 1 is a schematic exploded perspective view of a slider for slide fasteners according to a first embodiment of the present invention.
Figure 2:
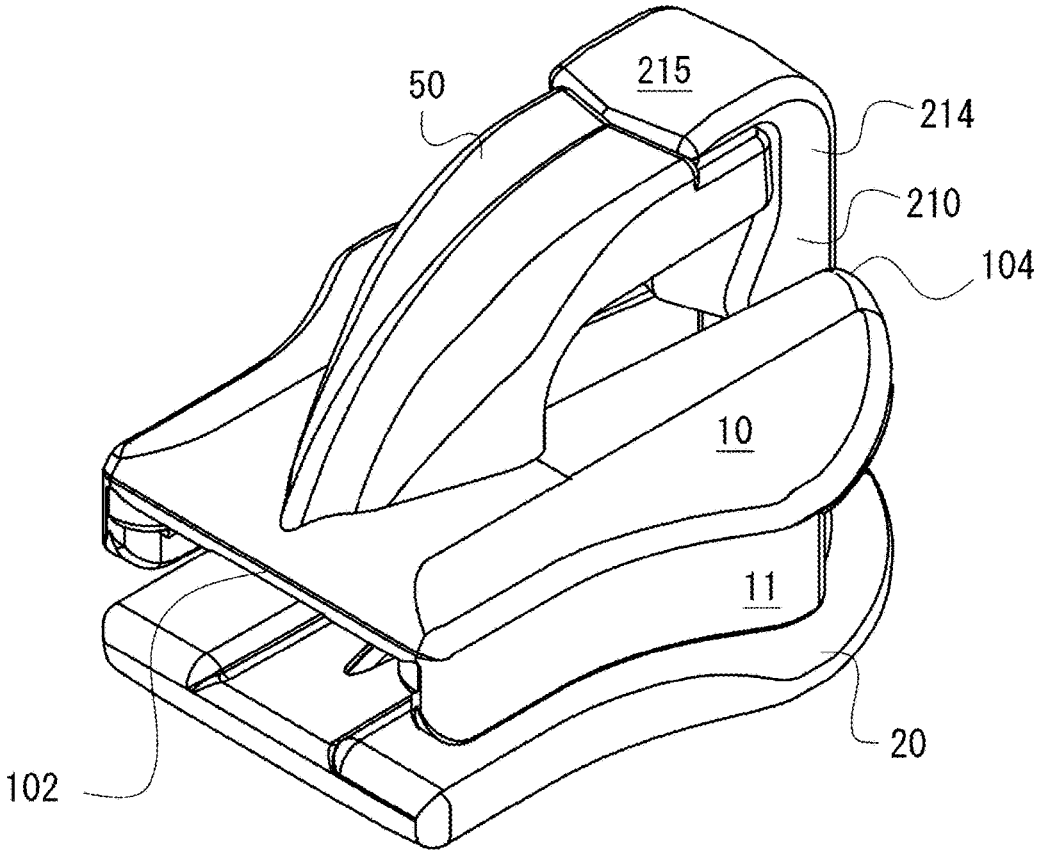
FIG. 2 is a schematic perspective view of a slider for slide fasteners according to a first embodiment of the present invention, showing that a closure part has been attached to the slider body. In this case, a pull tab is not shown.
Figure 3:
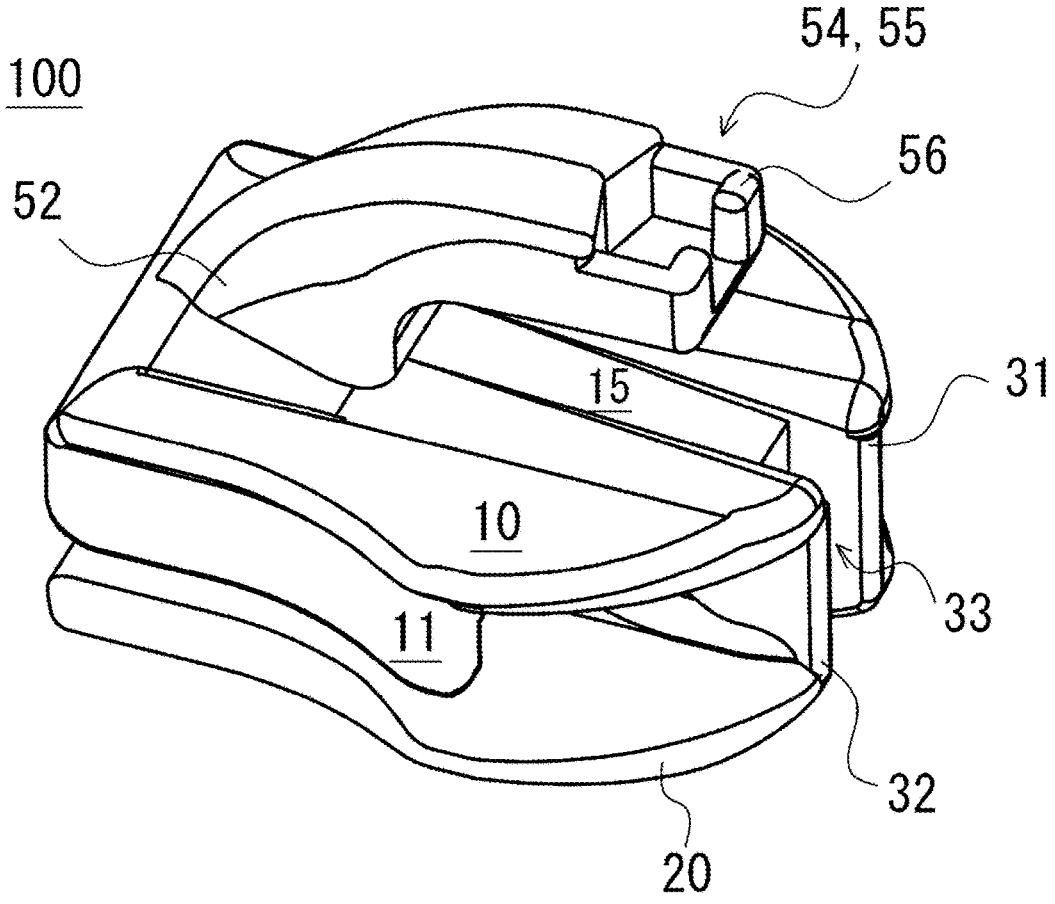
FIG. 3 is a schematic perspective view of a slider body in a slider for slide fasteners according to a first embodiment of the present invention, showing an upper blade and a pull tab attachment post in the slider body, perspectively viewed from an obliquely upward front.
Figure 4:
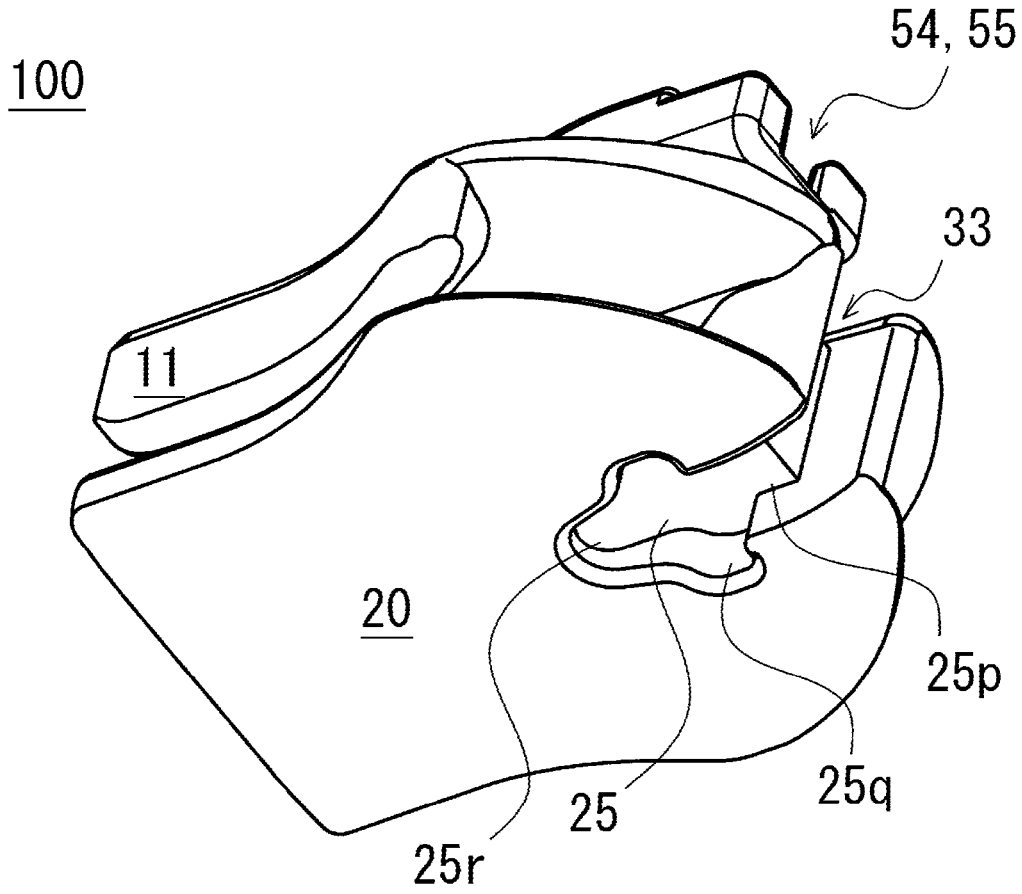
FIG. 4 is a schematic perspective view of a slider body in a slider for slide fasteners according to a first embodiment of the present invention, showing a bottom surface of a lower blade in the slider body, perspectively viewed from an obliquely lower front.
Figure 5:
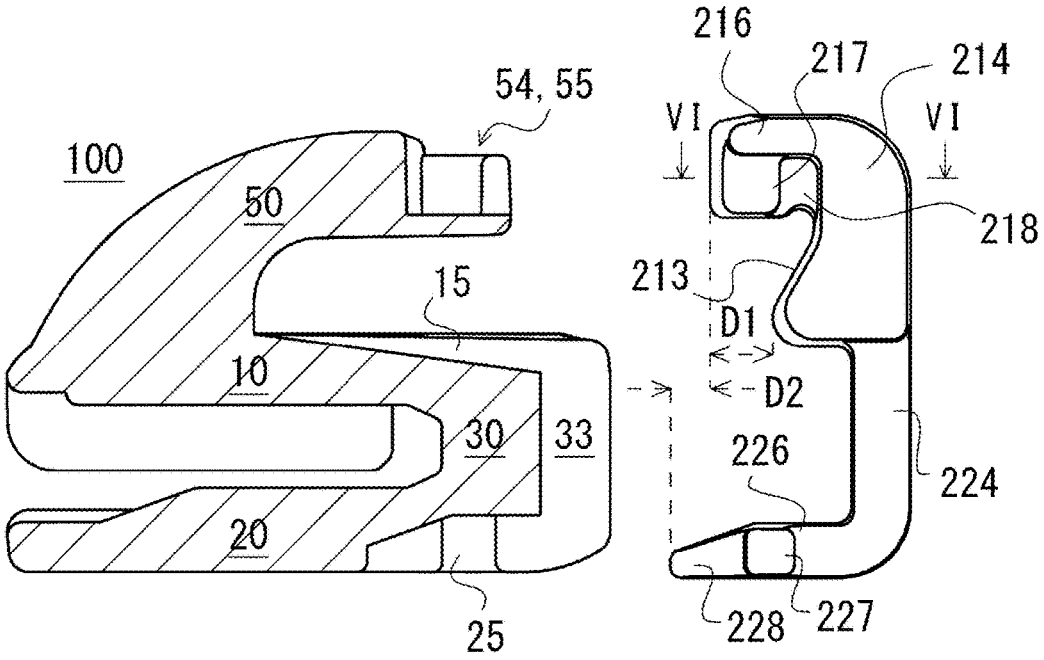
FIG. 5 is a schematic view showing both of a schematic cross-sectional view of a slider body in a slider for slide fasteners and a side view of a closure part according to a first embodiment of the present invention. In this case, the cross section of the slider body is taken along the plane of V-V in FIG. 9.
Figure 6:
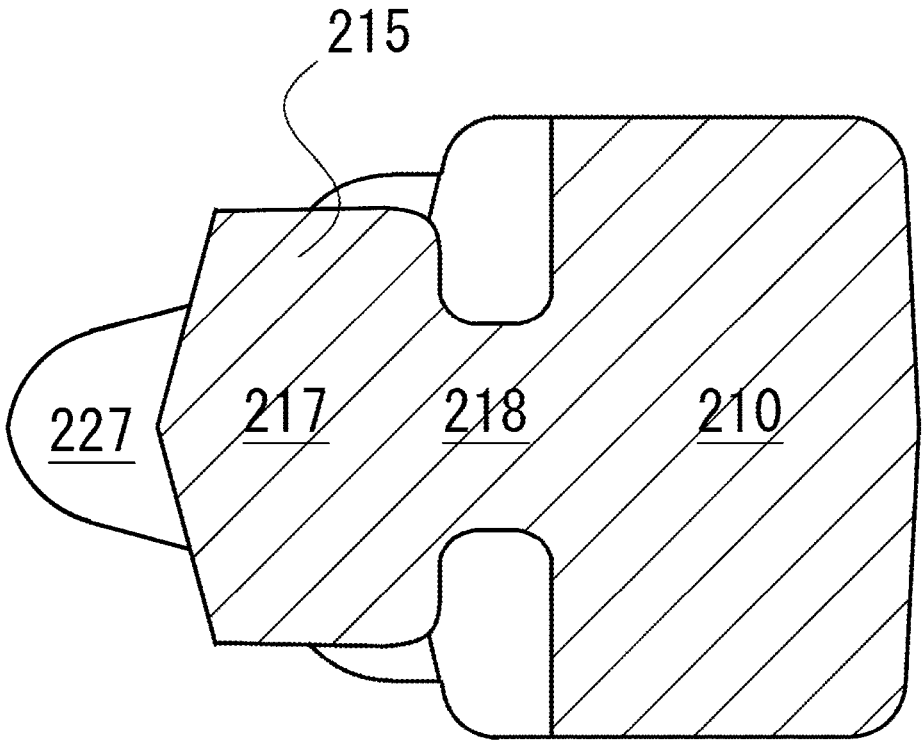
FIG. 6 is a cross-sectional view taken along the VI-VI plane in FIG. 5.
Figure 7:
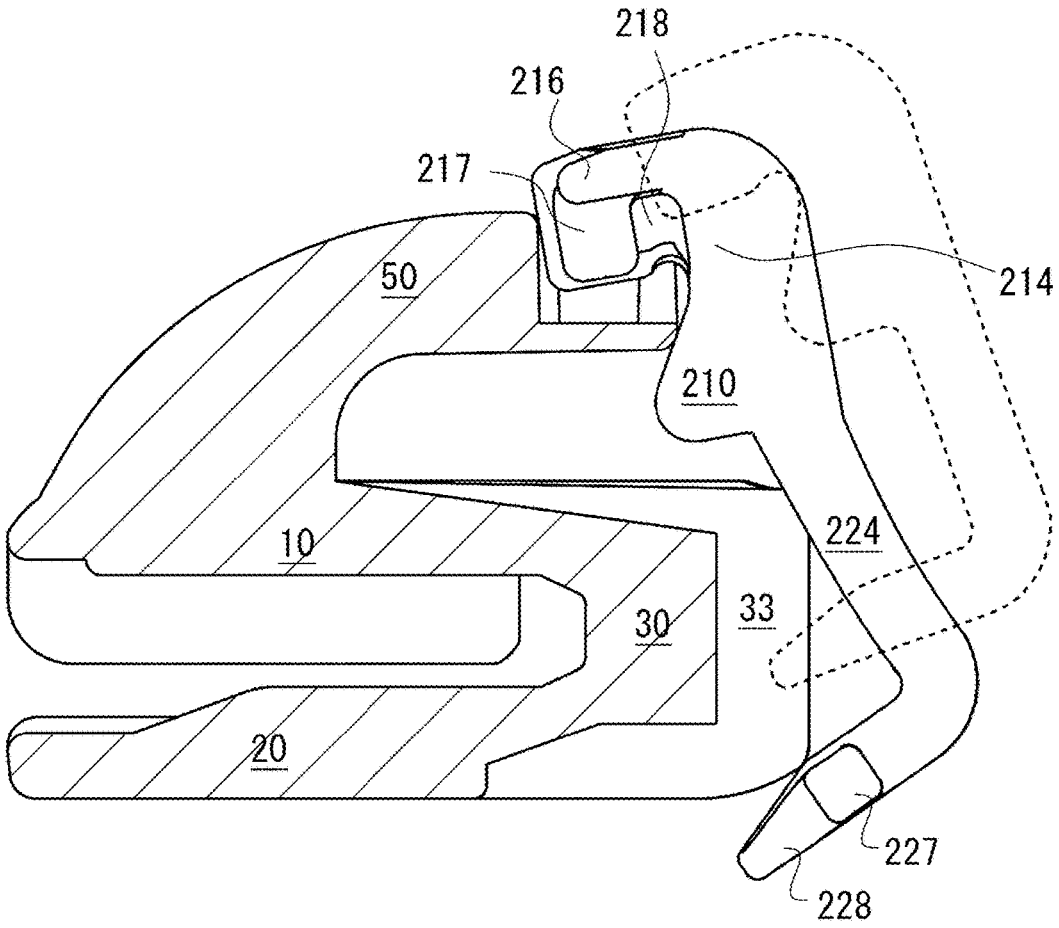
FIG. 7 is an explanatory view explaining a process of attaching a closure part to a slider body in a slider for slide fasteners according to a first embodiment of the present invention.
Figure 8:
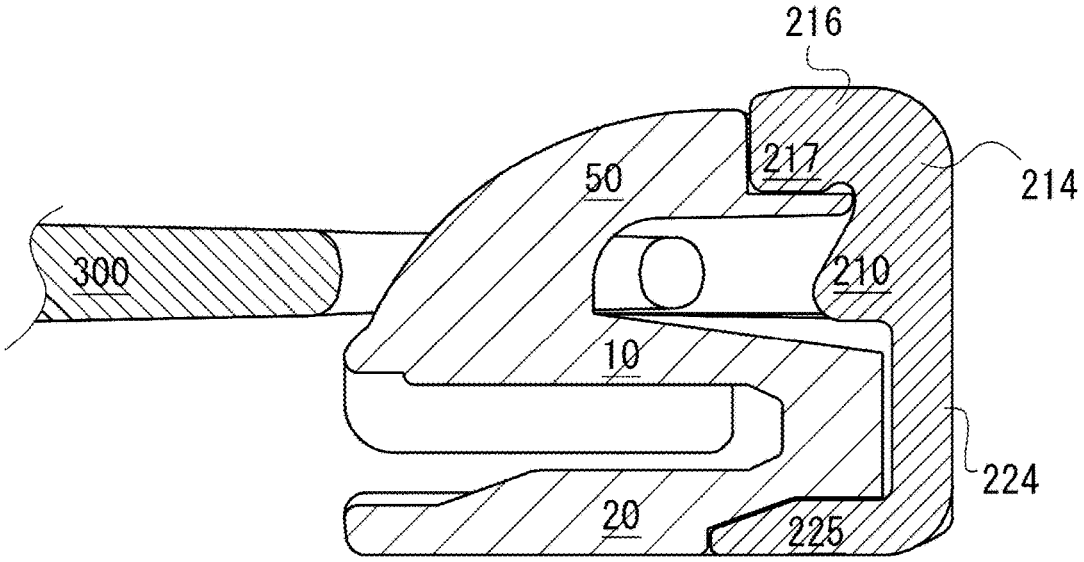
FIG. 8 is a schematic sectional view of a slider for slide fasteners according to a first embodiment of the present invention, which shows cross sections of a pull tab, a slider body, and a closure part.
Figure 9:
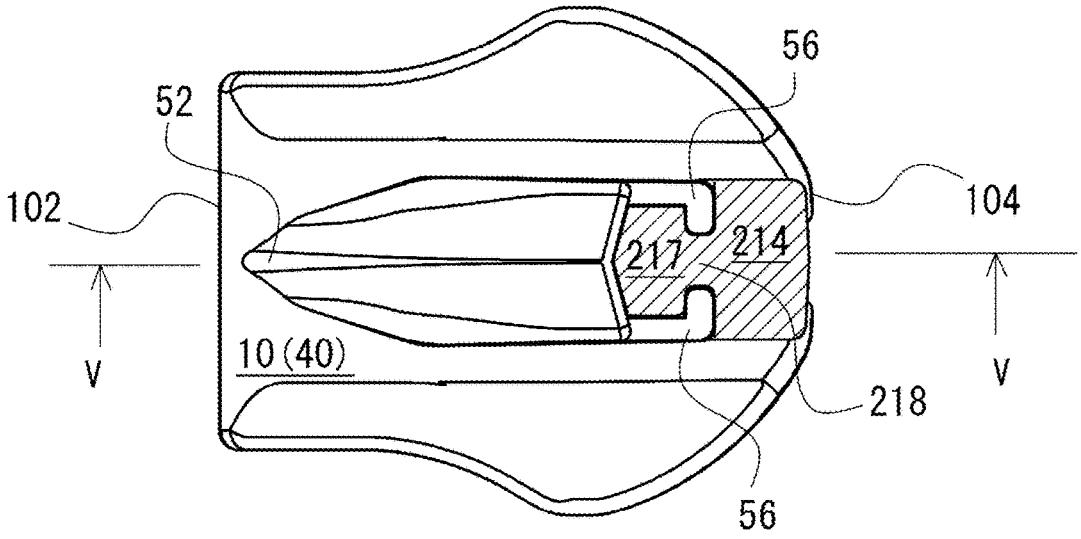
FIG. 9 is a schematic top view of a slider for slide fasteners according to a first embodiment of the present invention, showing that an upper engaging portion of a closure part has been engaged with an upper engaged portion on a free end of a pull tab attachment post, as a partial cross sectional view.
Figure 10:
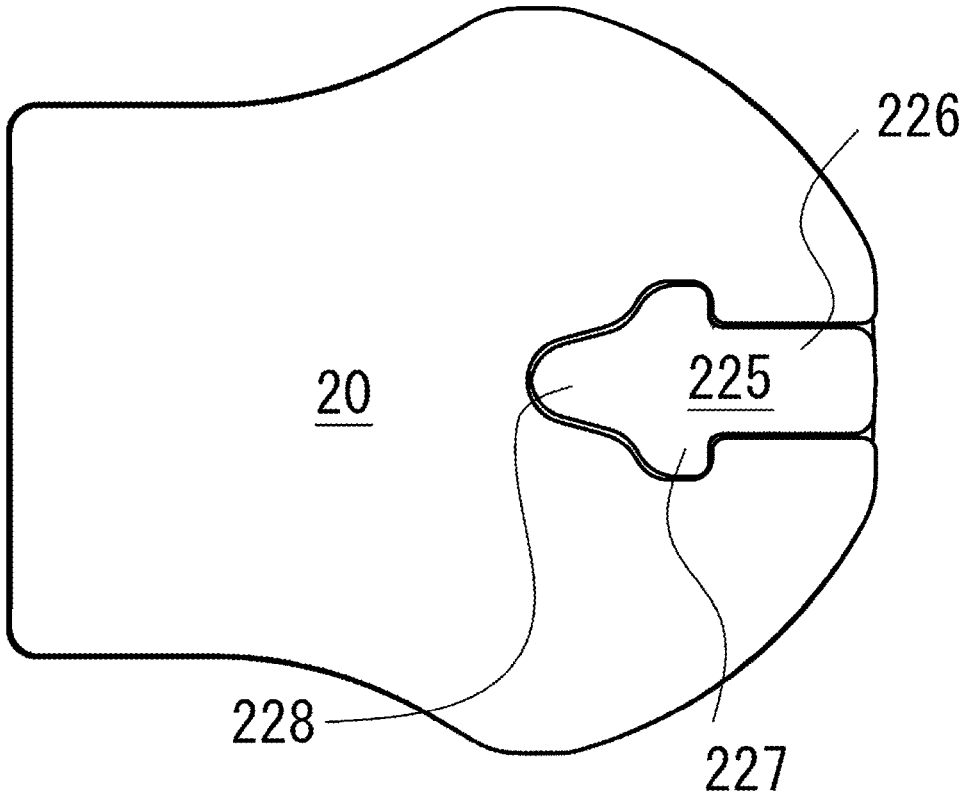
FIG. 10 is a schematic bottom view of a slider for slide fasteners according to a first embodiment of the present invention, showing that a lower engaging portion of a closure part has been engaged with a lower engaged portion of a lower blade.

The first embodiment will be described with reference to FIGS. 1 to 10. FIG. 1 is a schematic exploded perspective view of the slider for the slide fasteners. FIG. 2 is a schematic perspective view of the slider for the slide fasteners, showing that the closure part has been attached to the slider body. For simplification of illustration, the pull tab is not shown. FIG. 3 is a schematic perspective view of the slider body in the slider for the slide fasteners, showing the upper blade and the pull tab attachment post in the slider body, perspectively viewed from an obliquely upward front. FIG. 4 is a schematic perspective view of the slider body in the slider for the slide fasteners, showing the bottom surface of the lower blade in the slider body, perspectively viewed from an obliquely lower front. FIG. 5 is a schematic view showing both a schematic cross-sectional view of the slider body in the slider for the slide fasteners and a side view of the closure part. In this case, the cross section of the slider body is taken along the plane of V-V in FIG. 9. FIG. 6 is a cross-sectional view taken along the VI-VI plane in FIG. 5. FIG. 7 is an explanatory view explaining a process of attaching the closure part to the slider body of the slider for the slide fasteners. FIG. 8 is a schematic sectional view of the slider for the slide fasteners, which shows cross sections of the pull tab, the slider body, and the closure part. FIG. 9 is a schematic top view of the slider for the slide fasteners, showing that the upper engaging portion of the closure part has been engaged with the upper engaged portion on the free end of the pull tab attachment post, as a partial cross sectional view. FIG. 10 is a schematic bottom view of the slider for the slide fasteners, showing that the lower engaging portion of the closure part has been engaged with the lower engaged portion of the lower blade.

As illustrated in FIGS. 1 to 10, the slider 400 for the slide fasteners may have a slider body 100, a closure part 200, and a pull tab 300. The pull tab 300 may be attached to the slider body 100, and then the closure part 200 may be attached to the slider body 100. Since such an assembling procedure is permitted, subsequent attachment of the pull tab 300 may be possible. In other words, it may be possible to widen the degree of freedom of timing of attaching the pull tab 300 to the slider body 100. There may be also a merit that the slider 400 can be manufactured from the separated slider body 100 and pull tab 300. In addition, the two components of the slider body 100 and the closure part 200 being not attached to the slider body 100 are considered to be a component unit. The component unit may be also understood as comprising three components including the pull tab 300 additionally to the component unit.

It is noted that the pull tab 300 may be a metal flat plate which has a base end 302 and a grip end 304, and in which holes 320 and 340 are opened near their respective ends. The pull tab 300 may be attached to the pull tab attachment post 50 by passing the pull tab attachment post 50 through the hole 320 in the pull tab 300.

The slider 400 may be a slider for a slide fastener, and the slide fastener may be opened and closed by forward and backward movement of the slider 400. More particularly, left and right fastener elements may be engaged with one another by the forward movement of the slider 400, so that left and right fastener stringers may be closed. The backward movement of the slider 400 may release the engagement of the left and right fastener elements, so that the left and right fastener stringers may be opened. The slide fastener may be of any type and configuration. Also, the fastener elements may be of any type and configuration, and may include coil elements, resin elements, metal elements and the like.

Intended uses of the slide fastener incorporating the slider 400 may vary widely. For example, intended uses of the slide fasteners may include clothes, luggage, and bags. As described above, the slider 400 according to the present embodiment may allow subsequent attachment of the pull tab. Therefore, even if the pull tab of the slide fastener used for a wide variety of application as stated above may be damaged later, it can be addressed by replacing the damaged pull tub.

For example, it may be envisaged that the slider 400 is incorporated into the slide fastener sewn on a bag and the pull tab of the slider 400 is partially damaged, although it is not intended to be limited to this case. In this case, the damaged pull tab can be also replaced with a new or similar one by detaching the closure part 200 in the slider 400 from the slider body 100 through destruction or removal. This may avoid replacing the whole bag and may be matched with user's needs.

It may be desirable to prepare a new closure part 200 when replacing the pull tab. It may be not easy to detach the closure part 200 from the slider body 100 without deformation or damage. It may be convenient to break the closure part 200 for replacing the pull tab. Even if the closure part 200 was broken for some reason, the broken closure part can be replaced with a new one.

The slider body 100 may be made of a metal or a resin or any other materials. The closure part 200 may be made of a metal or a resin or any other materials. The pull tab 300 may be made of a metal or a resin or any other materials.

In one non-limiting example, the slider body 100 may be made of a metal, the closure part 200 may be made of a resin and the pull tab 300 may be made of a metal. In this example, the attachment of the closure part 200 to the slider body 100 is facilitated. In this example, the closure part 200 may be made of a resin that is rigid but somewhat soft. Thus, the closure part 200 may be made of a material softer than that of the slider body 100. The closure part 200 may be made of a molded product integrally formed by injection molding using, but not limited to, for example, a thermoplastic resin material and the like, such as polyacetals, polyamides, polypropylenes, and polybutylene terephthalate.

The slider body 100, the closure part 200 and the pull tab 300 may be manufactured by any manufacturing method. By way of example, the slider body 100 may be manufactured by die casting of a metal material, the closure part 200 may be manufactured by die molding of a resin, and the pull tab 300 may be manufactured by die casting of a metal material, but not limited thereto. The pull tab 300 made of a metal may provide a relatively strong impact to the closure part 200. This point may be remarkable, for example when compared with a pull made of a cord.

The slider body 100 may include an upper blade 10, a lower blade 20, a coupling post 30 coupling the upper blade 10 and the lower blade 20 at a front end portion 104 of the slider body 100, and a pull tab attachment post 50 provided at the upper blade 10 in the form of cantilever. The slider body 100 may have a rear end portion 102 and a front end portion 104. The front end portion 104 of the slider body 100 may be provided with a pair of front openings arranged at left and right sides of the coupling post 30. One rear opening may be provided at the rear end portion 102 of the slider body 100. The fastener elements may move in a Y-shaped element moving space defined by the upper blade 10, the lower blade 20 and the coupling post 30. The left and right fastener elements in the engaged state may enter and leave the rear opening, and the left and right fastener elements in the non-engaged state may enter and leave the pair of front openings arranged at left and right sides.

A pair of left and right flange portions 11 may be provided at the upper blade 10 to restrict any lateral displacement of the fastener elements. A guiding structure for guiding the fastener elements may be provided on each opposing inner surface of the upper blade 10 and the lower blade 20.

The shape and/or arrangement of the flange portion 11 may be changed depending on various conditions, such as for example, the configuration or use mode of the fastener stringer (also referred to as a fastener chain) on which the fastener elements have been fixed to the fastener tape. For example, when coil elements are attached to one surface of the fastener tape and the element row is used in a manner that is invisible from the front side, the flange portion 11 may be provided at the lower blade 20 instead of the upper blade 10. In the case of the fastener chain with resin elements integrally injection molded to a fastener tape or a fastener chain with metal elements crimped and fixed to the fastener tape, the flange portions 11 may be provided at both of the upper blade 10 and the lower blade 20.

The upper blade 10 and the lower blade 20 may be flat plates opposed to one another and having the same top view shapes. The coupling post 30 couples the front end portion of the upper blade 10 and the front end of the lower blade 20 at a center in the left and right direction. The coupling post 30 may have an upper end portion 31 coupled to the upper blade 10 and a lower end portion 32 coupled to the lower blade 20, and extends between the upper end portion 31 and the lower end portion 32. The coupling post 30 may be provided with a vertical groove 33 that may be front-open and may extend there-through in the up and down direction. In the vertical groove 33, a rod portion 224 of a leg portion 220 of the closure part 200 as described later may be housed and held.

The pull tab attachment post 50 may have a base end portion 52 coupled to the upper blade 10 and a free end portion 54 spaced from the upper blade 10. The pull tab attachment post 50 may extend from the base end portion 52 at the rear end portion 102 side of the slider body 100 toward the front end portion 104 of the slider body 100. The free end portion 54 of the pull tab attachment post 50 may be arranged over the front end portion 104 of the slider body 100 defining a gap 60 therebetween.

The top surface of the upper blade 10 may be provided with a lateral groove 15 extending from the base end portion 52 of the pull tab attachment post 50 to the front end portion 104. The width in the left and right direction of the lateral groove 15 may be less than that of the pull tab attachment post 50, and the depth of the lateral groove 15 gradually increases as it goes away from the base end portion 52 of the pull tab attachment post 50. The lateral groove 15 may be in spatial communication with the vertical groove 33 in the coupling post 30. The bottom surface of the lower blade 20 may be provided with a recessed lower engaged portion 25 to which a lower engaging portion 225 of a leg portion 220 of the closure part 200 as described below may be housed and held. The lower engaged portion 25 may be in spatial communication with the vertical groove 33 in the coupling post 30.

The spatial communication, as used herein, may be understood to indicate a shape in which the vertical groove 33, the lateral groove 15 and the lower engaged portion 25 are continuously cut off inward, respectively, from the top surface of the upper blade 10, the front surface of the coupling post 30 and the bottom surface of the lower blade 20, as can be seen from FIG. 5. Thus, the front end of the bottom surface of the lateral groove 15 and the upper end portion of the bottom surface of the vertical groove 33 may be continuously coupled to one another, and the lower end portion of the bottom surface of the vertical groove 33 and the front end portion of the bottom surface of the recessed engaged portion may be continuously coupled.

The closure part 200 may have a closure portion 210, an upper engaging portion 215 coupled to the closure portion 210, and a leg portion 220 coupled to the closure portion 210. The upper engaging portion 215 may be provided above the closure portion 210. The leg portion 220 may be provided below the closure portion 210 and may be coupled to the bottom surface of the closure portion 210. The leg portion 220 may include a rod portion 224 extending from the closure portion 210 along the coupling post 30 and a lower engaging portion 225 coupled to the rod portion 224 and engageable with the lower blade 20. The rod portion 224 may be a part interposed between the upper engaging portion 215 and the lower engaging portion 225, and may also be a part interposed between the closure portion 210 and the lower engaging portion 225.

The upper engaging portion 215 may engage with an upper engaged portion 55 provided at a free end portion 54 of the pull tab attachment post 50. The lower engaged portion 25 may engage with a lower engaged portion 25 provided at the lower blade 20. Sufficient connection between the slider body 100 and the closure part 200 may be ensured by the closure part 200 sandwiching the slider body 100 from the upper and lower sides.

The closure portion 210 may be present as a large lump/block and may have substantially the same lateral width as that of the pull tab attachment post 50, and may have substantially the same vertical dimension as that of the gap between the top surface of the upper blade 20 and the bottom surface of the free end portion of the pull tab attachment post 50. On the other hand, the lateral width of the leg portion 220 may be narrower than that of the closure portion 210, and may be a rod-like member which is bent in an L-shape so that the tip of the leg portion 220 faces backward. The leg portion 220 may be more flexible than the closure portion 210. The flexibility of the leg portion 220 may be advantageous in that the attachment of the closure part 200 to the slider body 100 may be facilitated.

The closure portion 210 may have a shape protruding rearward at its lower portion than at its upper portion, and in the closure portion 210, a slope 213 may be provided at a surface opposed to the base end portion 52 of the pull tab attachment post 50. The slope 213 rises upward as it extends away from the base end portion 52 of the pull tab attachment post 50. The slope 213 may be inclined in the forward direction from the top surface of the upper blade 10 to the free end portion 54 of the pull tab attachment post 50. When the pull tab 300 is pulled forward while maintaining a state where the closure part 200 has been attached to the slider body 100, a portion surrounding the hole 320 of the pull tab 300 ascends the slope 213 and is brought into contact with the pull tab attachment post 50. Force from the pull tab 300 may not be received only by the closure part 200, but the force may be received by both the pull tab attachment post 50 and the closure part 200, so that the force from the pull tab 300 may be dispersed.

The free end portion 54 of the pull tab attachment post 50 may be provided with an upper engaged portion 55. The upper engaged portion 55 may be recessed on a top surface 51 of the free end portion 54 of the pull tab attachment post 50. The upper engaged portion 55 may be depressed downward and opened upward, allowing insertion of the upper engaging portion 215 from above. In the illustrative embodiment shown, the upper engaged portion 55 may be a concave having a depth of half or more of the vertical dimension of the free end portion 54, and comprises a peripheral wall 56 provided so as to surround an engaging protrusion 217 of the upper engaging portion 215. The peripheral wall 56 may include right and left walls and a front wall, and may restrict left and right and forward and rearward displacement of the engaging protrusion 217. A center in the left and right direction of the front wall of the peripheral wall 56 may be cut off. The top surface of the peripheral wall 56 may be formed such that it is lower than the top surface at the highest position in the pull tab attachment post 50.

The upper engaging portion 215 may include a base portion 214 coupled to the closure portion 210, a cover portion 216 extending rearward from the base portion 214, an engaging protrusion 217 protruding downward from the cover portion 216, and a linking portion 218 linking the engaging protrusion 217 to the base portion 214. The upper engaging portion 215 may be provided so as to extend rearward as compared with the closure portion 210, thereby ensuring the allocation space for the engaging protrusion 217 protruding downward. The cover portion 216 may cover the free end portion 54 of the pull tab attachment post 50 from above, at least covering the upper engaged portion 55. The cover portion 216 may have a lateral width equal to that of the base portion 214. Each of the left and right upper edges, front edge, and rear edge of the cover portion 216 may be rounded. The engaging protrusion 217 may have the size slightly smaller than the size defined by the inner wall surface of the peripheral wall 56 of the upper engaged portion 55 and may be housed in the peripheral wall 56. As shown in FIG. 6, the tip of the engaging protrusion 217 may be formed in a substantially triangular shape with the center in the left and right direction protruding. As shown in FIG. 5, a distance D1 exists between the rear end position of the upper engaging portion 215 and the rear end position of the closure portion 210.

As shown in FIG. 9, the engaging protrusion 217 may include a wider portion protruding to the opposite side in the left and right direction to have a wider width. The engaging protrusion 217 may include a pair of protrusions protruding in the left and right direction. In another embodiment, the engaging protrusion 217 may include one protrusion protruding only in one of the left and right directions. The coupling portion 218 may be a narrower width portion having a narrower width in the left and right direction as compared with the engaging protrusion 217 having a wider width in the left and right direction. The wider width portion of the engaging protrusion 217 may be surrounded by the peripheral wall 56 as stated above. The narrower width portion of the coupling portion 218 may be inserted into the removal space of the peripheral wall 56 as stated above. The lateral width of the engaging protrusion 217 may be smaller than that of the cover portion 216.

The fitting of the engaging protrusion 217 with the peripheral wall 56 may restrict left and right and forward and rearward displacement of the upper engaging portion 215 of the closure part 200 with respect to the free end portion 54 of the pull tab attachment post 50. The upward movement of the engaging protrusion 217 from the peripheral wall 56 may be prevented by engagement between the lower engaging portion 225 and the lower engaged portion 25.

The rod portion 224 of the leg portion 220 may extend downward from the closure portion 210 along the coupling post 30. The upper end of the rod portion 224 may be coupled to the bottom surface of the closure portion 210. The lower engaging portion 225 may be bent at an angle of about 90° relative to the rod portion 224 and may extend rearward from the lower end of the rod portion 224. The rear end position of the lower engaging portion 225 may be provided rearward relative to the rear end position of the upper engaging portion 215, and between them, a distance D2 is present, as shown in FIG. 5. The attachment of the closure part 200 to the slider body 100 can be facilitated due to the distance D2.

The lower blade 20 may be provided with a lower engaged portion 25. The lower engaged portion 25 may be recessed on the bottom surface of the lower blade 20 and may be in spatial communication with the vertical groove 33. The lower engaged portion 25 may be opened at the lower and front sides, allowing insertion of the lower engaging portion 225 from the front or lower side. The lower engaged portion 25 may have a shape conforming to the lower engaging portion 225, for example, but not limited to, a concave portion having a shape similar to the lower engaging portion 225.

The lower engaging portion 225 may include a base portion 226 integrally coupled to the lower end of the rod portion 224 and having the same width as that of the rod portion 224 in the left and right direction; a wider intermediate portion 227 protruding in both of the left and right directions relative to the base portion 226 so as to have a wider width; and a narrower end portion 228 having a relatively narrower width in the left and right direction and tapered toward the tip thereof. The wider intermediate portion 227 may include a pair of protrusions that protrude in the left and right direction. In another embodiment, the wider intermediate portion 227 may include one protrusion that protrudes in the left and right direction. The lower engaged portion 25 may be provided with a first groove 25*p* for housing the base portion 226 of the lower engaging portion 225, a second groove 25*q* for housing the wider intermediate portion 227, and a third groove 25*r* for housing the narrower end portion 228. The second groove 25*q* may have a wider width in the left and right direction as compared with the first groove 25*p* and the third groove 25*r*. The thickness in the up and down direction of the lower engaging portion 225 gradually decreases from the wide intermediate portion 227 to the tip of the narrower end portion 228, and the top surface of the narrower end portion 228 may be provided with a slope slanted downwardly rearward.

The narrower end portion 228 positioned at the tip of the leg portion 220 compared to the wider intermediate portion 227 may facilitate attachment of the closure part 200 to the slider body 100, as schematically shown in FIG. 7. More particularly, the narrower end portion 228 of the lower engaging portion 225 may be inserted into the vertical groove 33 in the coupling post 30, so that the leg portion 220 of the closure part 200 may be bent in the forward direction relative to the closure portion 210. The lower engaging portion 225 of the leg portion 220 of the closure part 200 may move over the front edge on the bottom surface of the lower blade 20 while the narrower end portion 228 being guided by the vertical groove 33, and then moves backward along the bottom surface of the lower blade 20 and reaches the lower engaged portion 25 on the bottom surface of the lower blade 20 to be housed.

For specific procedures, for example, the engaging protrusion 217 of the upper engaging portion 215 may be inserted into the peripheral wall 56 of the upper engaged portion 55 from above, and force may be applied such that the leg portion 220 of the closure part 200 may be pressed into the vertical groove 33 on the coupling post 30. The lower engaging portion 225 then may move over the front edge on the bottom surface of the lower blade 20, reaches the lower engaged portion 25, and may be housed and held therein. In this way, the attachment of the closure part 200 to the slider body 100 may be achieved.

In this embodiment, the upper engaging portion 215 and the lower engaging portion 225 themselves do not undergo elastic deformation, thereby allowing a stronger attachment strength. Briefly, the wider width portion or the protrusion itself included in the engaging protrusion 217 does not undergo elastic deformation, and the wider width portion (the wider intermediate portion 227) or the protrusion itself included in the lower engaging portion 225 does not undergo elastic deformation. Specifically, the leg portion 220 may be elastically deformed, the distance in the up and down direction between the upper engaging portion 215 and the lower engaging portion 225 may be widened, and then the leg portion 220 elastically returns to the original shape, so that the distance in the up and down direction between the upper engaging portion 215 and the lower engaging portion 225 may recover to the original distance, and the upper engaging portion 215 and the lower engaging portion 225 are engaged with the upper engaged portion 55 and the lower engaged portion 25, respectively.

The dimension in the up and down direction of the lower engaging portion 225 may be set to be smaller than the dimension in the up and down direction of the upper engaging portion 215, and the rear end position of the lower engaging portion 225 may be provided rearward relative to the rear end position of the upper engaging portion 215, and the lower engagement portion 225 may be further provided with a narrower width end portion 228. Accordingly, the workability of attachment of the closure part 200 to the slider body 100 may be improved, and a stronger attachment strength may be ensured.

In some embodiments, it may be possible to attach the closure part 200 to the slider body 100 not only by a machine but also by a hand. It may be desirable to provide the closure part 200 with flexibility so as to permit deformation of the leg portion 220 with respect to the closure portion 210. The closure portion 210 serves as a base point or base portion for the attachment of the closure part 200 to the slider body 100. The component except for the leg portion 220, for example, the closure portion 210 may not have flexibility.

In this embodiment, the closure part 200 may include a leg portion 220 coupled to the closure portion 210, and the leg portion 220 may include a rod portion 224 extending from the closure portion 210 along the coupling post 30; and a lower engaging portion 225 coupled to the rod portion 224 and engageable with the lower blade 20. Even if local force acts on the closure portion 210 of the closure part 200, any detachment of the closure part 200 from the slider body 100 may be avoided owing to the lower engagement structure between the lower engaging portion 225 and the lower engaged portion, which may be positioned away from the upper engagement structure between the upper engaging portion 215 and the upper engaged portion 55. Further, since the closure part 200 may have a relatively large size, its handling becomes simple, thereby allowing easier attachment to the slider body 100. Again, attachment of the closure part 200 to the slider body 100 may be performed by a machine, human hands or a combination thereof.

In this embodiment, the upper engaging portion 215 may include an engaging protrusion 217 protruding downward, and the upper engaged portion 55 may include a peripheral wall 56 that opens upward. Insertion of the engaging protrusion 217 into the peripheral wall 56 can be relatively easily performed.

In this embodiment, the closure part 200 may be made of a material softer than that of the slider body 100. This may further facilitate the attachment of the closure part 200 to the slider body 100. Furthermore, in this case, the closure part 200 may be easily destroyed by a tool such as a cutter and a scissors, so that it is easy to replace the pull tab.

In this embodiment, the leg portion 220 of the closure part 200 may have flexibility, thereby ensuring simple attachment of the closure part 200 to the slider body 100.

In this embodiment, the coupling post 30 in the slider body 100 may be provided with a vertical groove 33 in which the rod portion 224 of the leg portion 220 may be housed and held. Accordingly, the rod portion 224 do not have any effect on operation of the slider 400. Further, it may be avoided that the rod portion 224 projects forward.

In this embodiment, when the lower engaging portion 225 of the closure part 200 may be housed in the lower engaged portion 25 of the lower blade 20, the bottom surface of the lower engaging portion 225 becomes flush with the bottom surface of the lower blade 20. Therefore, this prevents the lower engaging portion 25 from being perceived by a human skin as a protrusion.

In view of the above teachings, the skilled person could add various modifications to the respective embodiments. The reference numbers introduced in Claims are just for a reference, and should not be used for the purpose of narrowly construing claims.

The upper engaging portion 215 does not necessarily need to be engaged with the upper engaged portion 55 recessed on the top surface 51 of the free end portion 54 in the pull tab attachment post 50, and may be configured to engage with the upper engaged portion recessed on the bottom surface of the end portion 54 of the pull tab attachment post 50, as in Patent Document 1.

The longitudinal length of the pull tab attachment post 50 may be shortened, and to compensate for this, the upper engaging portion 215 may be further projected rearward. A plurality of engaging protrusions 217 may be provided at the upper engaging portion 215. In this case, the upper engaged portion 55 may be provided with a housing/recessed portion defined so as to match each engaging protrusion 217.

The lower engaging portion 225 may be further extended rearward. In this case, the lower engaged portion 25 may be also further extended rearward. The rod portion 224 of the leg portion 220 may protrude from the vertical groove 33 of the coupling post 30 to have any sectional shape in a plane orthogonal to the up and down direction. Individual specific shapes of the closure portion 210, the upper engaging portion 215 and the leg portion 220 may be changed as needed.

For the attachment of the closure part 200 to the slider body 100, the lower engaging portion 225 may be engaged with the lower engaged portion 25, and the upper engaging portion 215 may be then engaged with the upper engaged portion 55.

DESCRIPTION OF REFERENCE NUMERALS

400 slider
100 slider body
200 closure part
10 upper blade
20 lower blade
30 coupling post
50 pull tab attachment post
52 base end portion
54 free end portion
102 rear end portion
104 front end portion
210 closure portion
215 upper engaging portion

220 leg portion
224 rod portion
225 lower engaging portion

The invention claimed is:

1. A slider for slide fasteners, comprising:

a slider body that includes an upper blade; a lower blade; a coupling post; and a pull tab attachment post wherein the coupling post couples the upper blade and the lower blade at a front end portion of the slider body, and the pull tab attachment post extends from a base end portion thereof coupled to the upper blade to a free end portion thereof towards the front end portion as a cantilever; and a closure part that comprises a closure portion for closing a gap between the free end portion of the pull tab attachment post and the upper blade, wherein the closure part comprises an upper engaging portion provided at an upper section of the closure part and engaged with the free end portion of the pull tab attachment post; and a leg portion provided at a lower section of the closure portion, and wherein the leg portion comprises a rod portion extending from the closure portion along the coupling post; and a lower engaging portion coupled to the rod portion and engaged with the lower blade.

2. The slider according to claim 1, wherein a top surface of the free end portion of the pull tab attachment post is provided with a recessed upper engaged portion with which the upper engaging portion is engaged.

3. The slider according to claim 2, wherein the upper engaging portion has an engaging protrusion protruding downward, the upper engaged portion has a peripheral wall that is opened upward, and the engaging protrusion is housed in the peripheral wall.

4. The slider according to claim 1, wherein the coupling post has a vertical groove that is front-open and vertically extends through the coupling post, and the rod portion is at least partially housed in the vertical groove.

5. The slider according to claim 1, wherein the lower engaging portion is a flat plate portion bent relative to the rod portion, and is housed in a lower engaged portion recessed on a bottom surface of the lower blade.

6. The slider for a slide fastener according to claim 1, wherein when a direction in which the coupling post extends is defined as an up and down direction, a direction orthogonal to the up and down direction and consistent with a sliding direction of the slider is defined as a front and rear direction, and a direction orthogonal to the up and down direction and the front and rear direction is defined as a left and right direction, each of the upper engaging portion and the lower engaging portion has at least one protruding portion that protrudes in the left and right direction.

7. The slider according to claim 1, wherein a surface of the closure portion facing the pull tab attachment post is provided with a slope rising upward away from the base end portion of the pull tab attachment post.

8. A closure part attachable to a slider body that includes an upper blade; a lower blade; a coupling post; and a pull tab attachment post, the coupling post coupling the upper blade and the lower blade at a front end portion of the slider body, and the pull tab attachment post extending from a base end portion thereof coupled to the upper blade to a free end portion thereof towards the front end portion as a cantilever, the closure part comprising:

a closure portion for closing a gap between the free end portion of the pull tab attachment post and the upper blade;

an upper engaging portion provided at an upper section of the closure part and engageable with the free end portion of the pull tab attachment post; and a leg portion provided at a lower section of the closure portion, wherein the leg portion comprises:

a rod portion extending from the closure portion along the coupling post; and a lower engaging portion coupled to the rod portion and engageable with the lower blade.

9. A slider body that comprises an upper blade; a lower blade; a coupling post; and a pull tab attachment post, the coupling post coupling the upper blade and the lower blade at a front end portion of the slider body, and the pull tab attachment post extending from a base end portion thereof coupled to the upper blade to a free end portion thereof towards the front end portion as a cantilever, and a closure part being attachable to the slider body to close a gap between the free end portion of the pull tab attachment post and the upper blade, wherein the free end portion of the pull tab attachment post is provided with an upper engaged portion with which an upper engaging portion of the closure part is engageable, and wherein the lower blade is provided with a lower engaged portion with which a lower engaging portion of the closure part is engageable.

10. The slider body according to claim 9, wherein the coupling post has a vertical groove that is front-open and vertically extends through the coupling post, the coupling post being configured to house a rod portion interposed between the upper engaging portion and the lower engaging portion of the closure part.

* * * * *